United States Patent [19]

Sartor

[11] Patent Number: 4,577,421

[45] Date of Patent: Mar. 25, 1986

[54] FOOT LOCKING DEVICE PARTICULARLY FOR FRONT ENTRANCE SKI BOOTS

[75] Inventor: Mariano Sartor, Montebelluna, Italy

[73] Assignee: Nordica S.p.A., Montebelluna, Italy

[21] Appl. No.: 640,627

[22] Filed: Aug. 14, 1984

[30] Foreign Application Priority Data

Sep. 2, 1983 [IT] Italy ..... 22827/83[U]

[51] Int. Cl.[4] ..... A43B 5/04; A43B 11/00

[52] U.S. Cl. ..... 36/119; 36/117; 36/50; 36/58.5

[58] Field of Search ..... 36/89, 88, 117–121, 36/50, 58.5; 24/68 SK, 69 SK, 70 SK, 71 SK; 128/80 H, 166

[56] References Cited

U.S. PATENT DOCUMENTS 4,470,175 9/1984 Chiarella ..... 36/50 X

FOREIGN PATENT DOCUMENTS 0057170 1/1982 European Pat. Off. ..... 36/117
139988 12/1934 Fed. Rep. of Germany ..... 36/58.5
2534117 4/1984 France ..... 36/58.5
634727 2/1983 Switzerland ..... 36/117

*Primary Examiner*—James Kee Chi
*Attorney, Agent, or Firm*—Guido Modiano; Albert Josif

[57] ABSTRACT

A foot locking device for front entrance ski boots comprising a band element associated at its ends with the two parts of a locking lever provided on the flaps of a quarter. The band element crosses over at the rear of the skier's foot and is passed under the foot itself. The parts of the lever are slidably connected to the respective quarter flaps.

11 Claims, 2 Drawing Figures

FOOT LOCKING DEVICE PARTICULARLY FOR FRONT ENTRANCE SKI BOOTS

BACKGROUND OF THE INVENTION

This invention relates to a foot locking device particularly for front entrance ski boots.

A prior U.S. patent application Ser. No. 580,420 filed Feb. 15, 1984 by this same Assignee illustrates a foot locking or securing device for use with rear entrance ski boots.

That device is characterized by a closure lever between the front and rear quarters, which can also lock, with a single actuation movement, the foot instep such as to hold the user's foot securely within the boot.

That device has been specially designed for rear entrance ski boots.

SUMMARY OF THE INVENTION

It is an object of this invention to provide a device which can lock the foot in so-called front entrance ski boots, that is those ski boots which have a shell to which a quarter is connected for tightening onto the front.

A further object of the invention is to provide a foot locking device for front entrance ski boots, wherein it is also possible to use a locking lever which, additionally to tightening the quarter flaps against each other, can also operate, simultaneously with the closure, a device securely locking the foot inside the boot.

Another object of the invention is to provide a locking device of much simplified construction which poses no special constructional problems for its application to a front entrance ski boot.

A not unimportant object of this invention is to provide a foot locking device which can be readily formed from commercially available elements and materials, and which can be competitive from a purely economical standpoint.

These and other objects, such as will be apparent hereinafter, are achieved by a foot locking device particularly for front entrance ski boots, according to the invention, characterized in that it comprises a band element associated at its ends with the two parts of a locking lever provided on the flaps of a quarter, said band element crossing over at the rear of the skier's foot and being passed under the foot itself.

BRIEF DESCRIPTION OF THE DRAWINGS

Further features and advantages will be more readily understood from the following detailed description of a foot locking device particularly for front entrance ski boots, with reference to the accompanying illustrative and not limitative drawing, where.

DESCRIPTION OF THE PREFERRED EMBODIMENTS

Figure 1:
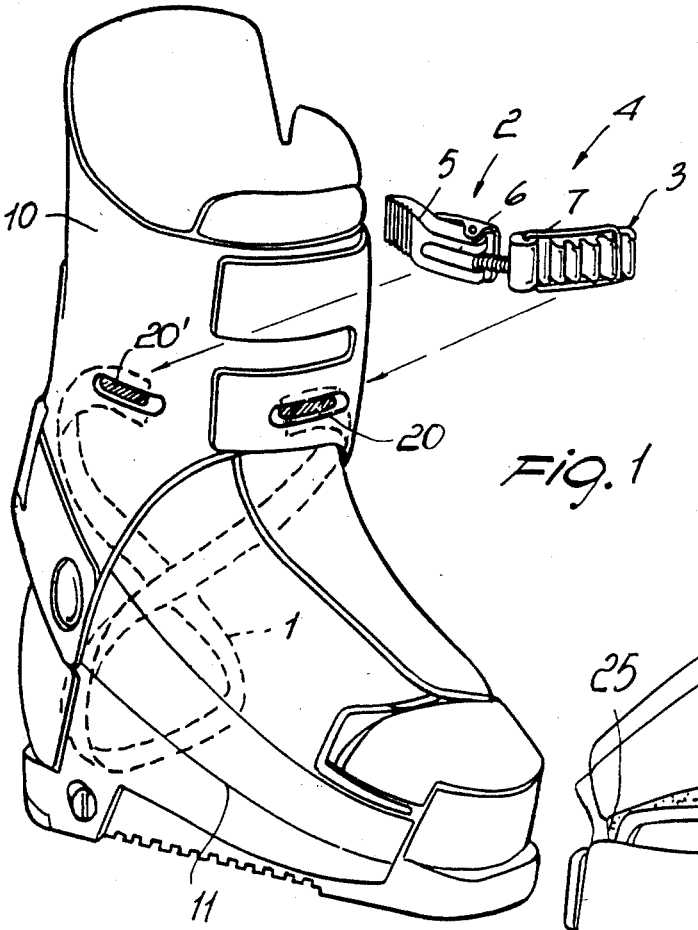
FIG. 1 shows schematically the device of this invention as applied to a ski boot, with the actuating lever removed to afford a better view of the device.

With reference to the drawing views, a foot locking device particularly for front entrance ski boots, according to the invention, comprises a band element, generally indicated at 1, which has its ends connected respectively to the first part 2 and second part 3 of a closure lever, generally indicated by the reference numeral 4, which may, evidently, be of any desired type.

In the example being described the lever has a lever arm 5 which is pivoted to a small plate 6 and connected to a ring 7 which can be locked to the toothed block forming the second part 3.

The plate 6 constituting a first connection element between the corresponding first end of the band-element 1 and the closure lever 4. The second part 3 of the closure lever 4 constituting the other connection element between the second end of the band element and the lever 4.

The cited lever 4 is a lever of the type normally utilized plurally to close or fasten a front entrance ski boot.

In that instance, the lever would be provided at the quarter 10 connected to a shell 11 of a ski boot having flaps which can be brought together on the front.

In the arrangement disclosed, the flaps whereon the lever 4 is applied are formed at their connection to the lever, with elongate slots 20, 20' which are mutually provided on both flaps and adapted to permit a relative sliding movement between the lever and flaps, such i.e. a free passage through the slots of component parts of lever that the closing action is effected on the flaps as the connection element between the two lever parts and the band element is located at the end of the slot 20 or 20'. In the embodiment shown the slot 20' is provided on a side portion of the quarter 10 which merges into a flap formation.

The cited band element 1 extends along a path which provides for the band element to be crossed over the rear portion of the foot, directly above the heel.

Furthermore, the band element extends below the insole 30, as normally equipping a ski boot, thereby the band element is passed under the foot, at the heel region thereof.

Thus, with the arrangement heretofore described, by acting on the lever, the band ends are brought together, along with the flaps of the quarter 10, and at the heel region where in practice the band would be crossing, a movement of the band and pressure against the heel region occurs which is directed towards the talus region 26 of the foot and while tends to securely tighten the heel in an exact, locked position within the boot.

Of noteworthy importance is that the heel is locked directly through one of the levers utilized for closing, or fastening, the boot, without involving any additional elements as are required by alternative conventional devices.

Figure 2:
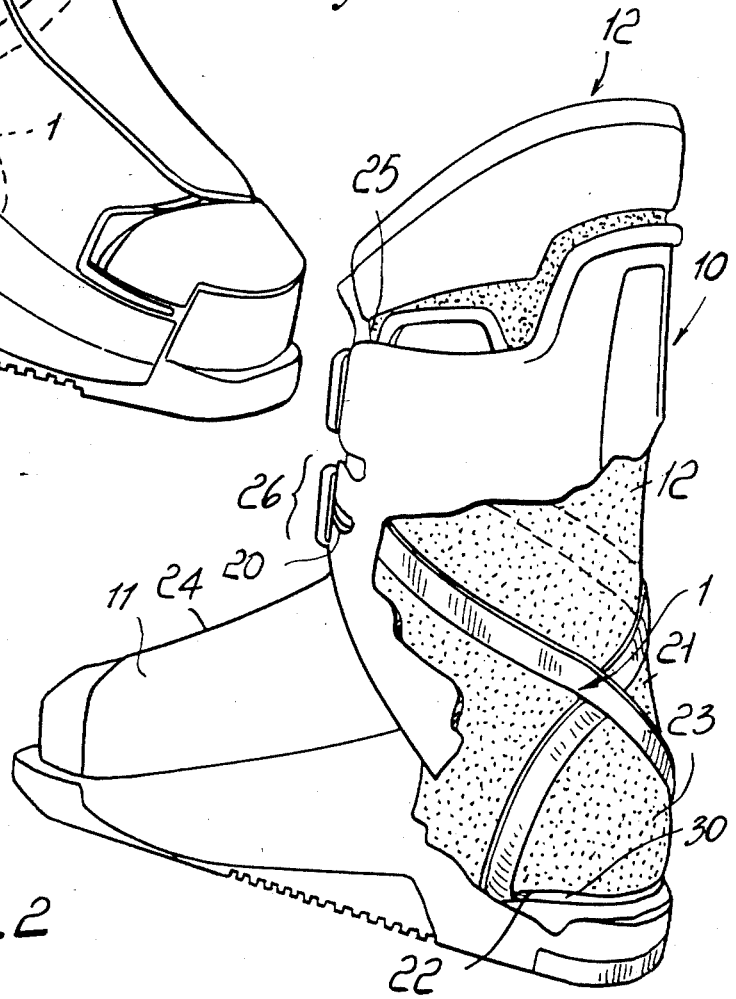
FIG. 2 is a partly cut-away view of a ski boot showing the pattern followed by the locking band.

As it appears clearly for FIG. 2 of the drawing in practice the band 1 acts internally onto an inner boot 12, such inner boot 12 having the following portions at regions corresponding to the well known anatomic parts of a human foot: a heel bottom region 22, an Achilles tendon region 2, an upper instep region 24, a front leg region 25, a talus region 26 joining the upper instep region 24 with the front leg region 25.

In practicing the invention, any materials, dimensions and contingent shapes, may be selected and used to meet individual requirements, providing that they are compatible with the intended application.

I claim:

1. A foot locking device particularly for a front entrance ski boot with a composite boot structure and with an inner boot arranged within said ski boot, the ski boot having a longitudinal direction, a widthwise direction and an upwards direction, the inner boot having outside surface portions facing said composite ski boot structure and including a heel bottom region surface portion extending along said longitudinal and widthwise directions, an Achilles tendon region surface portion extending in said upwards direction, an upper instep region surface portion, a front leg region surface portion, a talus region surface portion joining the upper instep region surface portion with the front leg region surface portion, the foot locking device comprising within said ski boot and between said composite structure thereof and said outside surface portions of said inner boot at least one flexible band-like member having at least one portion thereof facing said talus region surface portion, at least one end portion and at least another adjustable opposite end portion spaced from said one end portion thereof, at least one section of said flexible band-like member extending over said Achilles tendon region surface portion of said inner boot, said flexible band-like member having further at least one second section extending over said talus region surface portion, closure means connecting said one end portion and said another opposite end portion and adapted in closed position thereof to pull said one end portion and said another end portion towards each other thereby to tighten said band-like around said inner boot and press said at least one section of the band-like member against said Achilles tendon region surface portion in the direction towards said talus region surface portion.

2. A foot locking device particularly for a front entrance ski boot with a composite boot structure including a shell and a quarter connected to said shell and having front flaps and with an inner boot arranged within said ski boot, the ski boot having a longitudinal direction, a widthwise direction and an upwards direction, the inner boot having outside surface portions facing said composite ski boot structure and including a heel bottom region surface portion extending along said longitudinal and widthwise directions, an Achilles tendon region surface portion extending in said upwards direction, an upper instep region surface portion, a front leg region surface portion, a talus region surface portion joining the upper instep region surface portion with the front leg region surface portion and facing at least in part said front flaps, the foot locking device comprising within said ski boot and between said composite structure thereof and said outside surface portions of said inner boot at least one flexible band-like member having at least one end portion thereof facing said talus region surface portion and at least another adjustable opposite end portion facing said quarter and spaced from said one end portion thereof, at least two sections of said flexible band-like member extending over said Achilles tendon region surface portion of said inner boot, said two sections crossing each other, said flexible band-like member having further at least one second section extending over said talus region surface portion, closure means on said quarter and connecting said one end portion and said another opposite end portion to pull in closed condition thereof said one end portion and said another end portion towards each other thereby to tighten said band-like around said inner boot and press said at least one section of the band-like member against said Achilles tendon region surface portion in the direction towards said talus region surface portion.

3. A device according to claim 2, wherein said band-like member has a third section extending over said heel bottom region surface portion and joining said two sections crossing each other.

4. A device according to claim 2, comprising one of said flaps overlapping said one end portion of said band-like member and having a first slot extending within limits in said widthwise direction and facing said one end portion and wherein said closure means have a first end thereof connected with said one end portion of said band-like member past said slot, and wherein said quarter has a side portion with a second slot extending within limits in said widthwise direction at a distance from said first slot, said second slot overlapping said another opposite end portion of said band-like member, and wherein said closure means have a second end thereof connected with said another opposite end portion of said band-like member past said second slot thereby to move, when said closure means are actuated, said one end portion and said another opposite end portion within limits along said first and said second slot, respectively, thereby to adjust the tightening of said band-like member around said inner boot and at the same time adjust the closing degree of said flaps when said one end portion and said another opposite end portion are moved beyond limits relative to said first and said second slots respectively thereby entraining therewith said one of said flaps and said side portion of said quarter.

5. A foot locking device particularly for front entrance ski boots including flaps adapted to be closed together, said device comprising at least one band element having at least one end, at least one other end and at least one intermediate portion, and at least one locking lever having at least two parts mutually associable is releasably lockable engagement relationship for closing said flaps of said ski boot, said at least one end of said band element being associated with one of said at least two parts of said locking lever, said at least one other end of said band element being associated with another of said at least two parts of said locking lever, said intermediate portion of said band element extending from said at least one end over a front part and a heel part of a skier's foot, and extending therefrom to said at least one other end, said locking lever being actuable for fastening said flaps adapted to be closed together and for tightening and causing said band element to exert a foot locking force on a skier's foot.

6. A foot locking device particularly for front entrance ski boots according to claim 5, comprising two consecutive intermediate portions of said band element crossing each other and extending as a continuation thereof over the rear portion of a skier's foot directly above a heel region thereof and under a skier's foot at said heel region thereof.

7. A foot locking device particularly for front entrance ski boots according to claim 5 wherein said at least two parts of said locking lever are slideably connected to said flaps of said quarter, said at least two parts being adapted for moving relatively to said flaps and towards each other upon actuation of said locking lever.

8. A foot locking device particularly for front entrance ski boots according to claim 5 wherein said at least one end and said at least one other end of said band element are each respectively connected to said at least two parts of said locking lever including at least one connection element by means of which the connection occurs, and wherein each of said flaps of said ski boot associated with said at least two parts of said locking lever has at least one elongate slot formed therein, said connection element being at least partially accommodated in said elongate slot, and adopted for limited sliding movement therealong.

9. A foot locking device according to claim 8, wherein said elongate slot defines a longitudinal extension, and wherein said sliding movement of said at least one connection element in said at least one elongate slot defines an excursion, said longitudinal extension of said elongate slot delimiting said excursion of said at least one connection element.

10. A foot locking device particularly for front entrance ski boots according to claim 5 wherein said ski boot further comprises an insole, said band element being adapted to be passed under said insole.

11. A foot locking device particularly for front entrance ski boots according to claim 8 wherein said sliding movement of said at least one connection element in said at least one elongate slot is effected by actuation of said locking lever for closing together said flaps of said ski boot.

* * * * *